US007624549B2

(12) United States Patent
Kopish

(10) Patent No.: US 7,624,549 B2
(45) Date of Patent: Dec. 1, 2009

(54) WALL-CEILING SLIP JOINT PERMITTING SEISMIC INDUCED MOVEMENT

(75) Inventor: Andrew J. Kopish, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 127 days.

(21) Appl. No.: 11/844,856

(22) Filed: Aug. 24, 2007

(65) Prior Publication Data

US 2009/0049766 A1 Feb. 26, 2009

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |

(52) U.S. Cl. ..... 52/243.1; 52/242

(58) Field of Classification Search ..... 52/241, 52/242, 243.1, 126.4, 167.1

See application file for complete search history.

(56) References Cited

U.S. PATENT DOCUMENTS

| | | | | |
|---|---|---|---|---|
| 2,443,548 | A * | 6/1948 | Wilson | 52/126.3 |
| 3,386,216 | A * | 6/1968 | Zwickert | 52/205 |
| 3,511,000 | A * | 5/1970 | Keuls | 52/126.4 |
| 3,696,569 | A * | 10/1972 | Didry | 52/126.4 |
| 3,707,060 | A | 12/1972 | Jansen, Jr. | |
| 4,037,380 | A | 7/1977 | Pollock | |
| 4,103,463 | A * | 8/1978 | Dixon | 52/126.4 |
| 4,163,348 | A * | 8/1979 | Thomas, Jr. | 52/241 |
| 4,186,534 | A * | 2/1980 | Le Coze | 52/241 |
| 4,277,920 | A * | 7/1981 | Dixon | 52/64 |
| 5,140,792 | A | 8/1992 | Daw et al. | |
| 5,237,786 | A * | 8/1993 | Kochansky | 52/126.4 |
| 5,481,834 | A * | 1/1996 | Kowalczyk et al. | 52/64 |
| 2001/0032424 | A1 * | 10/2001 | Goldsmith et al. | 52/238.1 |
| 2009/0049766 | A1 * | 2/2009 | Kopish | 52/167.1 |

* cited by examiner

*Primary Examiner*—Richard E Chilcot, Jr.
*Assistant Examiner*—Andrew J Triggs
(74) *Attorney, Agent, or Firm*—Andrus, Sceales, Starke & Sawall, LLP

(57) ABSTRACT

A wall panel-ceiling engagement device is designed to couple a wall panel to a ceiling. The engagement device, when engaged with the ceiling, holds the wall panel stationary without any fasteners, braces or other securing members that penetrate into the ceiling. The engagement device includes a pair of wall extensions secured to opposite sides of the wall panel and that contain a sound and/or attenuating material, such as a foam material, therebetween. Corner braces are used to join adjacent wall-panels to one another. The corner braces also function to allow the wall panels to sway as a collective and connected unit during seismic events.

19 Claims, 6 Drawing Sheets

WALL-CEILING SLIP JOINT PERMITTING SEISMIC INDUCED MOVEMENT

BACKGROUND OF THE INVENTION

This invention pertains to partition wall systems and, more particularly, to an engagement assembly that couples a wall panel to the ceiling without piercing the ceiling itself. The engagement assembly may also provide a sound and light attenuation barrier. The present invention is believed to be particularly applicable for wall systems located in areas prone to measurable seismic events.

Increasingly, interconnected modular wall systems are being used to define offices, conference rooms, storage rooms, and workrooms. The wall systems are not designed to be load bearing. As such, they can be fastened to the floor and the suspended ceiling of a building at nearly any location. As the needs for the office space change, such as with a new tenant, the wall systems can be rearranged or replaced, as needed, without affecting the structural integrity of the building. An exemplary modular wall system is the Genius wall system, commercially available from Krueger International, Inc. of Green Bay, Wis.

New seismic regulations require that a suspended ceiling be able to sway like a pendulum a predetermined distance, e.g. one inch, in all directions in response to a seismic event. This can be particularly problematic for wall panels that are attached, using fasteners or similar connectors, directly to the suspended ceiling. Moreover, code requirements demand that the wall panels be able to withstand the impact of a seismic event. This has led to the design of sturdier wall panels. While having an improved response to seismic events, the seal between the suspending ceiling and the wall panel can be susceptible to sound and/or light transference. This has led to the need for a series of braces above the ceiling (called kicker braces) that support the walls that can be expensive and time consuming to install. The kicker braces attach to the top of the wall and to the building structure above the ceiling at 45 degrees every four feet. The penetration through the suspended ceiling has to be large enough for the brace plus one inch clearance around the brace to allow the ceiling to sway unobstructed. This penetration can be wider than the width of the wall, which can compromise the effectiveness of the wall system.

Thus, there is a need in the art for a modular wall system for use in seismic active areas that is compliant with seismic-related building codes, but also provides noise and light abatement that does not penetrate the ceiling.

BRIEF DESCRIPTION OF THE INVENTION

This disclosure is directed to a modular wall system used in a space dividing system, such as an office space configuration system, suitable for seismic active areas. The system includes a partition wall or wall panel designed to extend between the floor of the office interior and the ceiling. The partition wall is held stationary in this position without any fasteners, braces or other securing members that penetrate into the ceiling. To hold the partition wall in position against the ceiling, the wall includes a pair of wall extensions secured to opposite sides of the wall and that contain a sound attenuating material, such as a foam material or fiberglass therebetween.

Therefore, in accordance with one aspect of the present invention, an apparatus for retaining a wall panel to a ceiling surface is presented. The apparatus includes a pair of wall extensions adapted to abut against the ceiling surface and a guide that retains the wall extensions, and which carries a shank. The apparatus further includes a spacer coupled to the shank and adapted to snugly retain the wall extensions against the wall panel. The height of the wall panel relative to the spacer is defined by the position of the spacer relative to the shank.

In accordance with another aspect, the present invention is directed to a wall system adapted for use in regions with seismic building criteria. The wall system includes a wall panel and a spacer connected to the wall panel. The wall system further includes a wall extension member adapted to abut a ceiling and further adapted to adjustably retain the spacer at one of a plurality of heights.

According to another aspect, the present invention is directed to an apparatus for extending the height of a wall panel to traverse a distance between a floor surface supporting the wall panel and a ceiling surface. The apparatus includes a pair of wall extensions adapted to snugly fit against respective exterior wall surfaces of the wall panel. A guide removably retains the pair of extensions and carries a threaded spacer that threadedly receives a bolt adapted to carry the wall panel. The height of the wall extensions relative to the wall panel is set by the position of the bolt on the threaded spacer, such that the extensions can be positioned against the ceiling surface.

Various other features, objects and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION

Figures 1, 7:
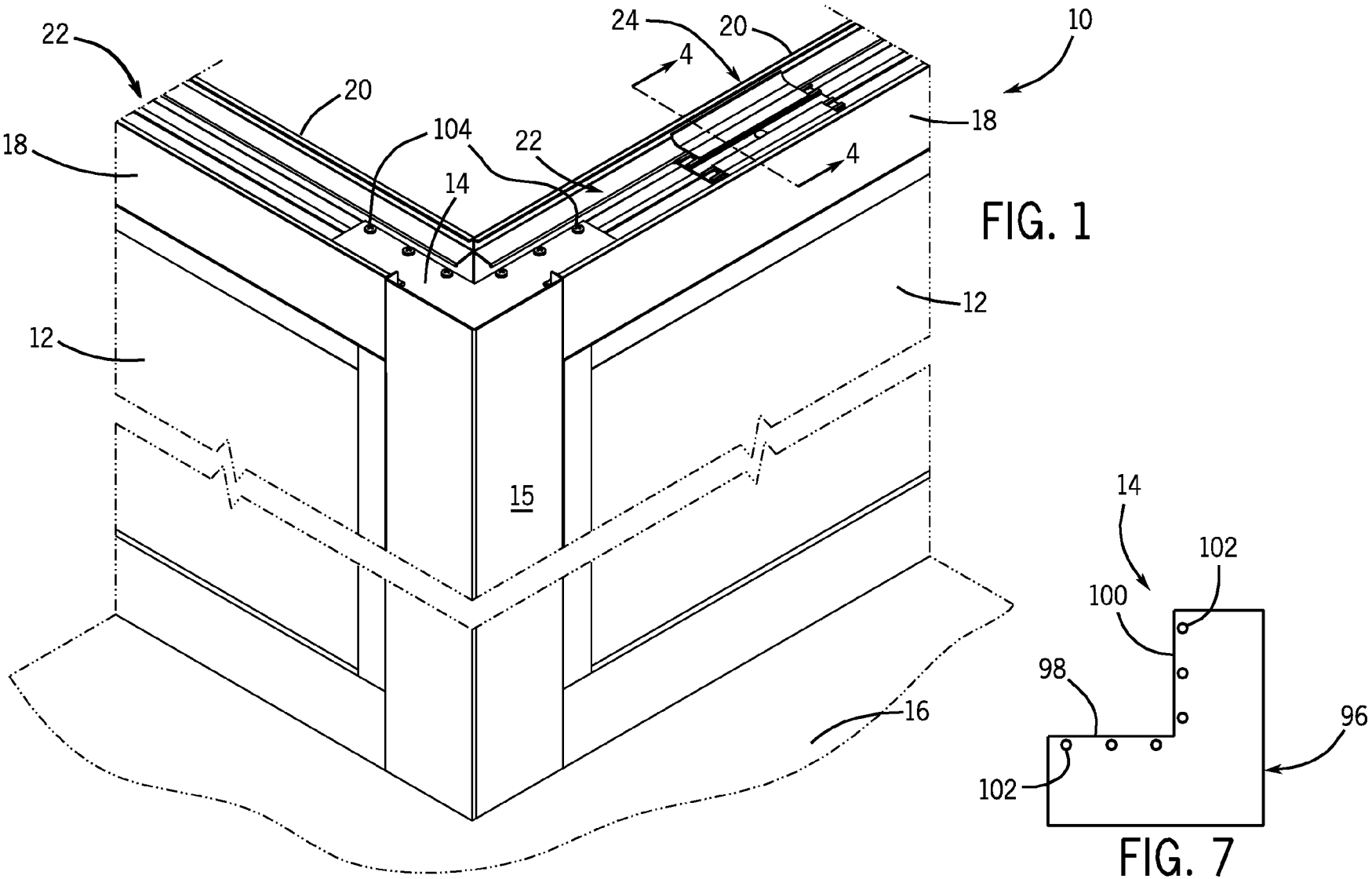
FIG. 1 is a partial isometric view of a modular wall system in which the upper end of the panels of the wall system are adapted to engage the ceiling of a space within a building using the wall panel-ceiling engagement assembly according to the present invention.
FIG. 7 is an isometric view of a corner brace used to join adjacent panels.

FIG. 1 shows a portion of a modular wall system 10 composed of a pair of wall panels (or partition walls) 12 connected to one another by a corner brace 14. A corner cover 15 extends from the corner brace 14 and runs the height of the pair of wall panels 12 and assists in connecting the adjacent wall panels 12 to one another. As will be described with respect to FIG. 7, the corner brace 14 allows the joined wall panels to swing as a single structure during seismic events. The wall panels 12 are designed to abut the underside of a suspended ceiling (not shown) via a slip joint connection, which will be explained. As will also be explained in greater detail below, the wall panels 12 are constructed to be shorter than the distance between the suspended ceiling and a floor, shown at 16. The gap between each wall panel 12 and the ceiling is traversed by a pair of wall extensions 18, 20 designed to abut against the underside of the suspended ceiling and be retained thereagainst without the use of a fastener or similar device penetrating through the ceiling. A channel 22 is defined between the wall extensions 18, 20 which, in a preferred embodiment, is filled with light and sound abatement material, such as foam or insulation. In addition, a wall panel-ceiling engagement device or assembly 24 is retained within the channel 22 and, as will be described, receives the wall extensions 18, 20 in a manner that allows the height of the wall extensions 18, 20 relative to the wall panel 12 to be adjusted.

Wall system 10 may be generally constructed as shown and described in U.S. Pat. No. 6,688,056 granted Feb. 10, 2004, the disclosure of which is hereby incorporated by reference. It is understood, however, that wall system 10 may have any other desired construction. With additional reference to FIG. 2, each section of wall panel 12 includes an upper frame member 26. The upper frame member 26 has a lower surface 28 interconnected between a pair of sidewalls 30, 32 having inwardly projecting flanges 34, 36, respectively. Flanges 34, 36 are engaged with and received by the wall panel-ceiling engagement device 24, in a manner to be explained, so as to couple the wall panel 12 to the wall panel-ceiling engagement device 24. Alternately, sheet metal screws or similar fasteners may be used.

Figure 2:
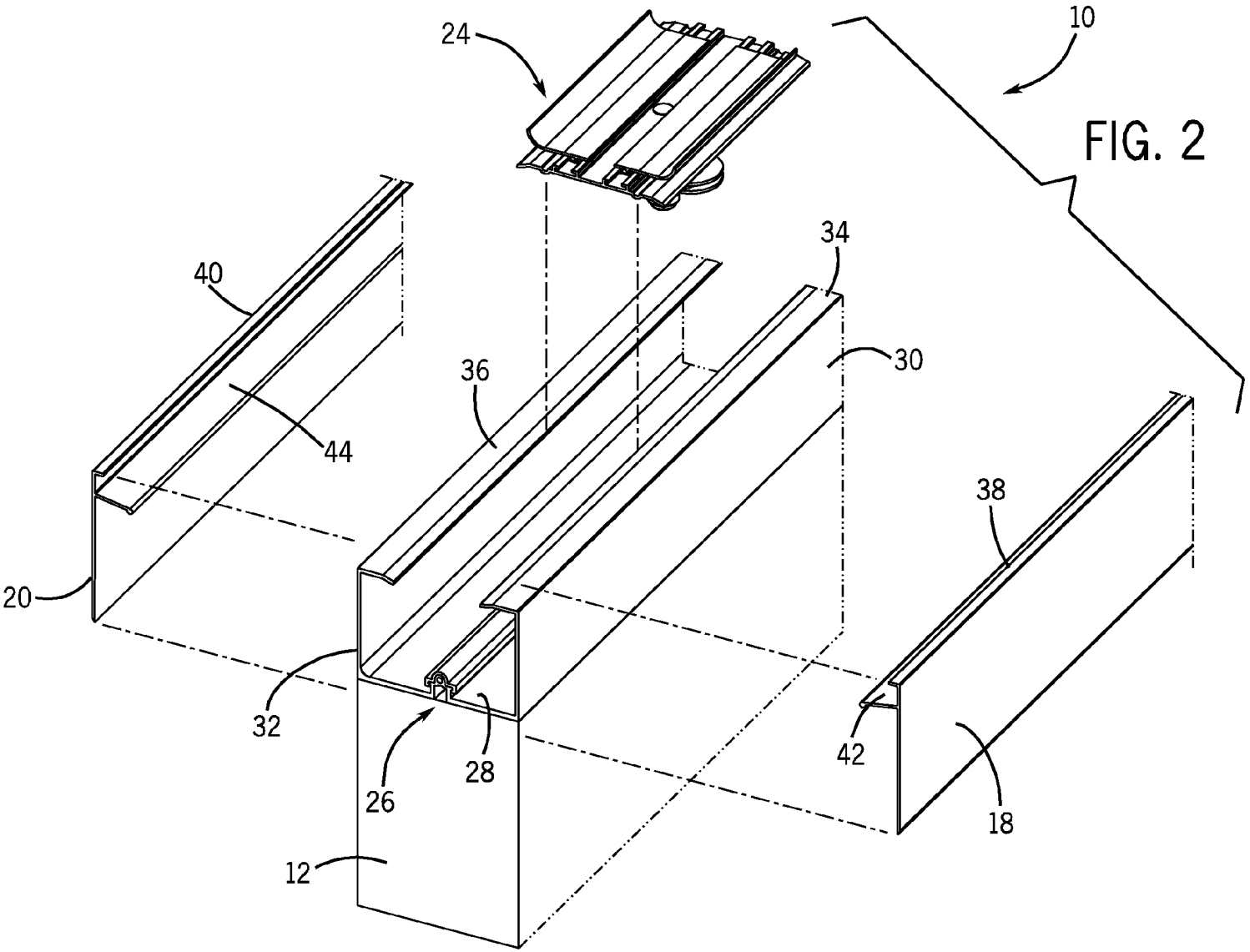
FIG. 2 is a partial, enlarged exploded isometric view of the wall panel-ceiling engagement assembly incorporated in the modular wall system of FIG. 1.

As also shown in FIG. 2, wall extensions 18, 20 are designed to abut exteriorly of sidewalls 30, 32, respectively, of upper frame member 26. Each wall extension 18, 20 is constructed to have a lip 38, 40, respectively, that is designed to abut against the underside of a ceiling, which representatively may be a suspended ceiling. Additionally, wall extensions 18, 20 have respective inwardly extending arms 42, 44. Arms 42, 44 are designed to be retained by the wall panel-ceiling engagement device 24, thereby coupling the wall extensions 18, 20 to the wall panel-ceiling engagement device 24.

Figure 3:
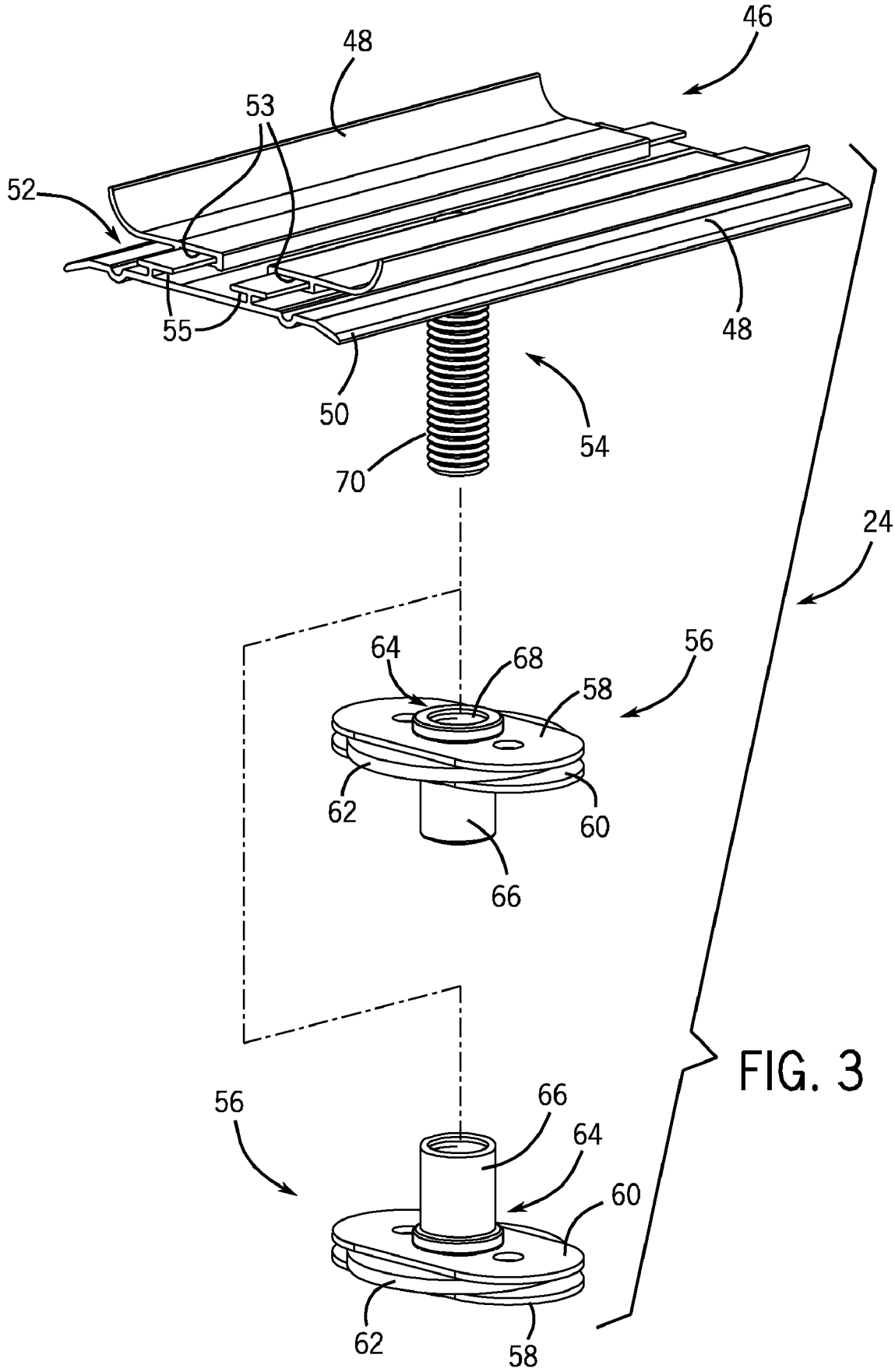
FIG. 3 is an exploded isometric view of a guide forming a part of the wall panel-ceiling engagement assembly of FIG. 2.

More particularly and with additional reference to FIG. 3, wall panel-ceiling engagement device 24 has a guide 46 composed of a pair of top guide plates 48 connected to a bottom guide plate 50 in a manner such that a gap 52 is formed therebetween. Gap 52 forms a receptacle or space for receiving arms 42, 44 of the wall extensions 18, 20. A stud or bolt 54 extends downwardly from guide 46 and is constructed to receive a spacer 56.

In the illustrated embodiment, the top guide plates 48 and the bottom guide plate 50 are in the form of extruded members formed of a material such as aluminum or steel, although it is understood that any other satisfactory material and forming method may be employed. Top guide plates 48 and bottom guide plate 50 include mating connection structure that enables guide plates 48, 50 to be connected together. As shown in FIG. 3, the mating connection structure may be in the form of a pair of upwardly facing T-connectors 53 formed on lower guide member 50, each of which is adapted to fit within a respective channel 55 formed on upper guide plates 48. Alternatively, the mating connection structure may be in the form of facing channels formed on lower guide plates, which receive T-shaped connectors formed on the upper guide plate.

Figure 4:
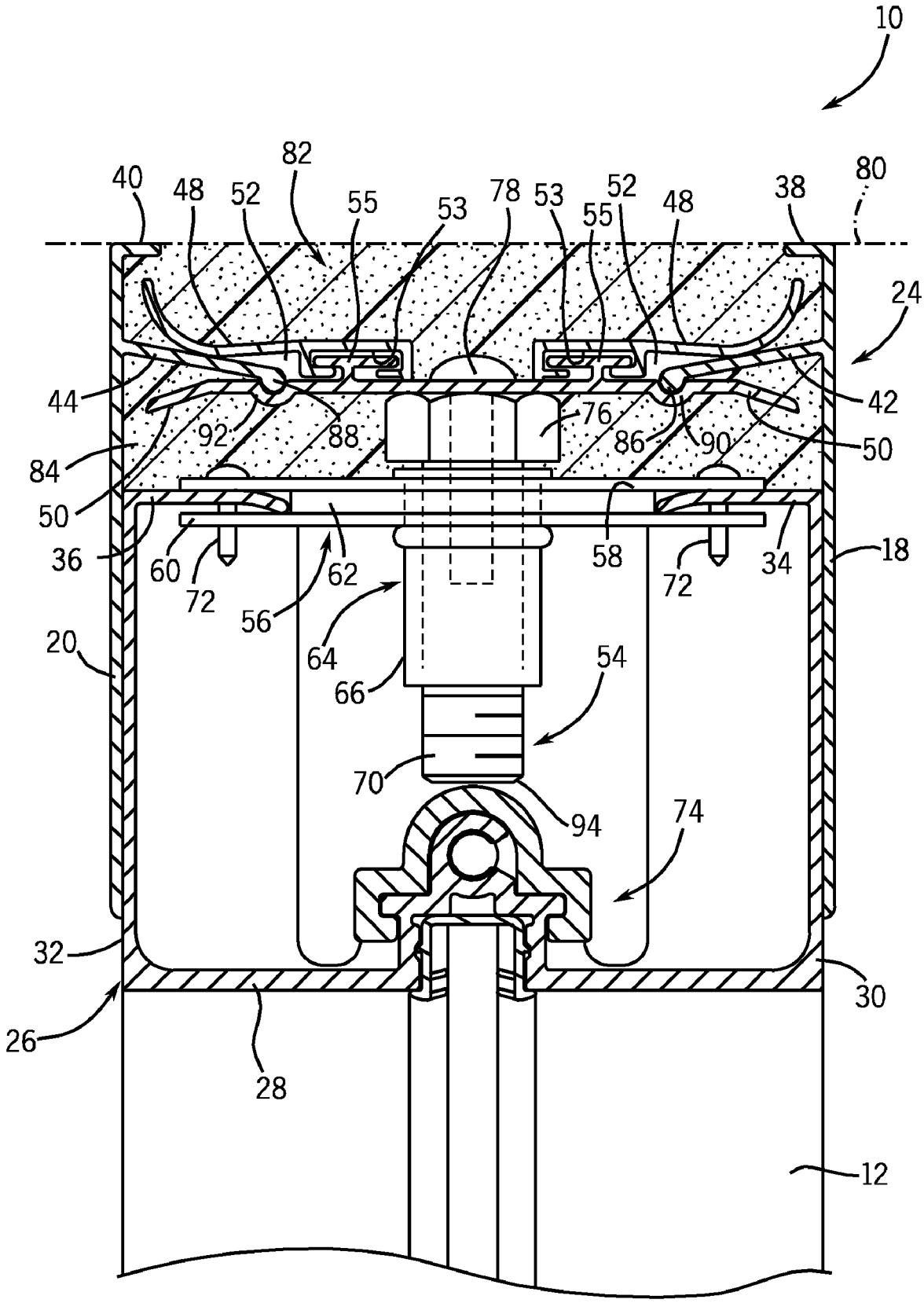
FIG. 4 is a section view of the modular wall system taken along lines 4-4 of FIG. 1.

As shown in FIGS. 3 and 4, spacer 56 includes a pair of spacer plates 58, 60 separated from one another by a center plate 62. A grommet 64 has a barrel 66 that extends centrally through plates 58-62, and includes an interior wall 68 having threads that engage threads 70 of the bolt 54 when the spacer 56 is threaded onto bolt 54 or bolt 54 is threaded into grommet 64. It is contemplated that the spacer 56 may be threaded onto bolt 54 with the grommet 64 facing downward or with the grommet facing upward, with both positions being illustrated in FIG. 3.

Center plate 62 is angularly offset from plates 58, 60 thereby forming a channel between plates 58, 60 that is adapted to receive flanges 34, 36. Center plate 62 has a width that matches the distance between the facing edges of flanges 34, 36. As shown in FIG. 4, flanges 34, 36 are received in the channel and abut the lateral edges of center plate 62. In one preferred embodiment, screws or rivets 72 fixedly attach flanges 34, 36 to plates 58, 60. Thus, the wall panel 12 is attached to spacer 56 by upper frame member 26. It is noted that that wall panel 12 is also fixedly coupled to the upper frame member 26 by a channel and lock assembly 74, as known in the art. Alternately, spacer 56 may be screwed directly to the upper frame member 26.

Still referring to FIG. 4, wall panel-ceiling engagement device 24 further includes a spacing bolt 76 coupled to guide 46 by a retention pin 78. Spacing bolt 76 defines a minimum distance between spacer plate 58 and guide 46. That is, spacing bolt 76 is operative as a stop for the spacer 56 thereby providing a rotational limitation for the spacer when being threaded to bolt 54. In one embodiment, spacing bolt 76 is coupled to a retention rivet 78. More particularly, the head of the bolt 76 has a clearance hole extending at least partially therethrough. Rivet 78 passes through the clearance hole in aluminum extrusion and into the hole in the head of the bolt 76. This allows the spacer to be adjusted up and down without spinning around. That is, a user can clip one wall extension onto one side, adjust the bolt until the wall extension makes contact with the ceiling, install noise and/or light abatement material if desired, and clip on the other wall extension knowing that the spacer is properly adjusted.

Wall extensions 18, 20, flanges 34, 36, spacer plate 58, and ceiling 80 collectively form a cavity 82 that, in one preferred embodiment, is filled with sound and light abatement material 84. In one embodiment, the sound and light abatement material is insulating foam or fiberglass, but is recognized that other sound and light abatement materials may be used. It is also contemplated that the sound and light abatement materials may also be deposited in the space formed between spacer 56 and the bottom surface 28 of the upper frame member 26.

As noted above, guide 46 is constructed to form a gap 52 adapted to receive arms 42, 44 of wall extensions 18, 20, respectively. As shown in FIG. 4, arms 42, 44 have rounded ends 86, 88, respectively, that rest within grooves 90, 92, respectively, formed in the lower guide plate 50. When the arms 42, 44 are fully inserted, rounded ends 86, 88 sit in grooves 90, 92, respectively, and top guide plates 48 exert a downward bias on arms 42, 44, that forcibly engage arms 42, 44 with lower guide plate 50. In this manner, the arms 42, 44, and thus the wall extensions 18, 20, are securely coupled to guide 46. Moreover, the top guide plate 48 pressing down on the arms 42, 44 causes the wall panel-ceiling engagement device 24 to rotate down sealing against the wall panel 12.

Figure 5:
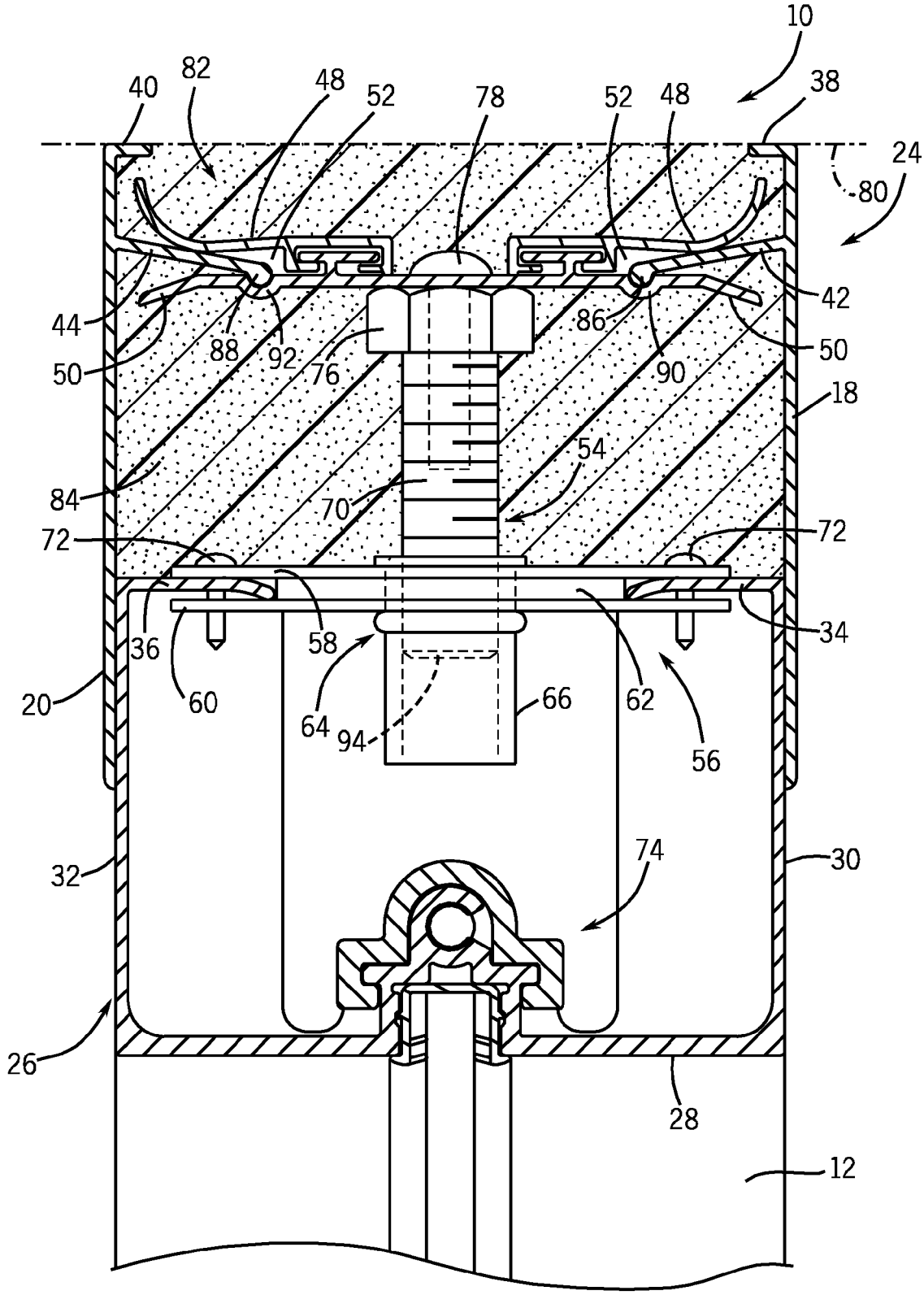
FIG. 5 is a section view similar to that of FIG. 4 showing the wall panel-ceiling engagement assembly being retained at an elevation greater than that shown in FIG. 4.

The height of the wall extensions 18, 20 relative to the wall panel 12 is determined by the position of spacer 56 on bolt 54. For instance, FIGS. 4 and 5 show two possible positions of the wall extensions 18, 20 relative to the wall panel 12. In FIG. 4, the wall extensions 18, 20 are closer to the top of the wall panel 12 than in FIG. 5. This is a result of spacer 56 being threaded higher up on bolt 54 in FIG. 4 than in FIG. 5. As shown in FIG. 5, the threaded grommet 64 allows the spacer 56 to be retained on the bolt 54 even when the distal end 94 of the bolt 54 does not extend past the grommet 64, as shown in FIG. 4.

Figure 6:
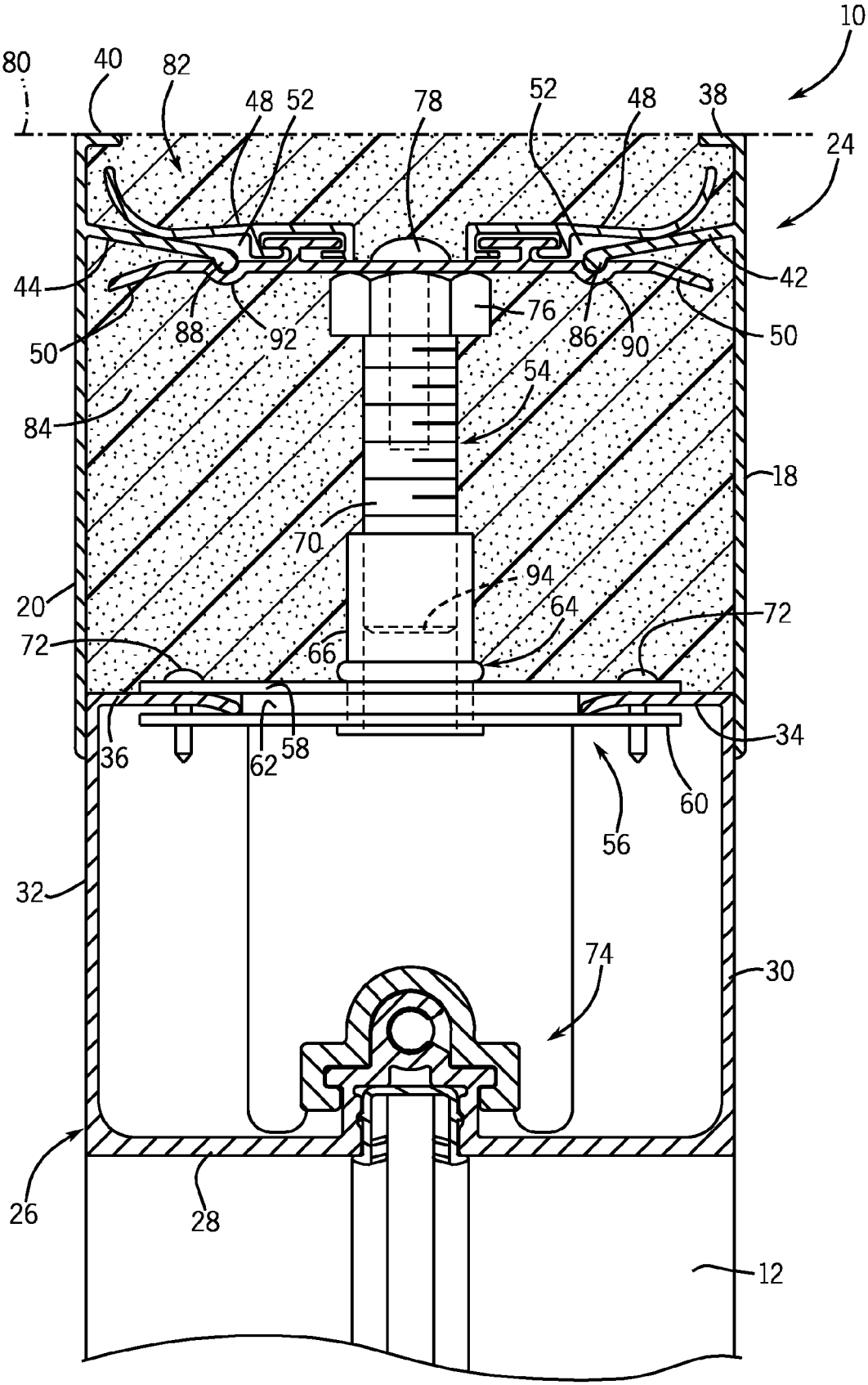
FIG. 6 is a section view similar to that of FIGS. 4 and 5 showing the wall panel-ceiling engagement device being retained at an elevation greater than shown in both FIGS. 4 and 5.

As noted previously with respect to FIG. 3, spacer 56 may be oriented in two different positions. One position is shown in FIGS. 4-5 whereas the other position is shown in FIG. 6. In the position shown in FIG. 6, the barrel 66 of the grommet 64 is rotated 180 degrees from the position shown in FIGS. 4-5. This allows the distance between the guide 46 and the spacer 56 to be greater than that possible when the spacer is oriented in the manner shown in FIGS. 4-5. For example, in both FIGS. 5 and 6, the spacer is retained at the sixth lowest thread 70 of bolt 54. However, because the spacer 56 has been rotated or inverted in the orientation shown in FIG. 6, the space between the guide 46 and the spacer 56 is greater than that of FIG. 5 even though the top of the spacer 56 is retained on the sixth lowest thread 70 in FIG. 5.

When assembling the wall system 10, the upper frame member 26 is secured to the wall panel 12, and the wall panel 12 is then placed in a desired position on the floor 16 such that the upper frame member 26 is located adjacent and below the ceiling, shown at 80. Spacer 56 is then secured to the flanges 34, 36 using screws 72. This is followed by coupling the guide 46 to the spacer 56. Once a proper height of the guide 46 has been attained by adjusting the position of the bolt 54 relative to the spacer 56, one of the wall extensions 18, 20 is snapped into place, as described above. Noise and light abatement material 84, such as foam, is then preferably placed into the cavity 82 defined between the ceiling 80 and the spacer 56. The other wall extension 18, 20 is then snapped into place, thereby securing the noise and light abatement material 84.

When assembled, the wall panel 12 is retained against the suspended ceiling 80, without the use of fasteners penetrating ceiling 80, by the noise and light abatement material and the lips 38, 40 of the wall extensions 18, 20, respectively, in a manner that allows wall panel 12 to slip or sway in accordance with government regulations in response to a seismic event. The noise and light abatement material provides insulation against the ingress and egress of noise and light between rooms or spaces, and the variability permitted in retaining the bolt 54 in spacer 56 allows the wall panel 12 to be used in buildings of differing ceiling heights.

Referring now to FIG. 7, a corner brace 14 for connecting a pair of wall panels 12 to one another is shown. In the illustrated example, the corner brace 14 is adapted to connect wall panels 12 that are arranged perpendicular to one another, but it is recognized that the corner brace 14 may be modified to connect wall panels 12 that are inline with one another. Additionally, the corner brace 14 may be modified to connect more than two wall panels to one another.

In the illustrated example, corner brace 14 has an L-shaped body 96 that defines a first leg 98 and a second leg 100 that extends along an axis perpendicular to that of the first leg 98. Holes 102 are formed in a spaced arrangement along the body 96 are designed to receive fasteners 104, FIG. 1, such as screws, bolts, pins, rivets, and the like, to connect each leg 98, 100 to a respective wall panel 12. Since the wall panels 12 are generally free standing structures, the corner brace 14 functions to join adjacent wall panels 12 such that the wall panels 12 support each other. Thus, during seismic events, for example, the corner brace 14 functions to keep the wall panels 12 upright notwithstanding swaying of the wall panels 12 themselves. In other words, the connected wall panels 12 sway as a collective unit.

It is understood that the body 96 could be shaped to have more than two legs such that more than two wall panels 12 could be connected using a single brace 14. For example, a three-way brace could be used to connect three panels together and a four-way brace could be used to connect four panels together. Additionally, while in a preferred embodiment each of the legs are perpendicular to one another, it is understood that for some applications it would be desirous for the brace to connect wall panels arranged at non-right angles to one another.

The present invention has been described in terms of the preferred embodiment, and it is recognized that equivalents, alternatives, and modifications, aside from those expressly stated, are possible and within the scope of the impending claims.

I claim:

1. An apparatus for spanning a space between a wall panel and a ceiling surface, the apparatus comprising:
   - a pair of wall extensions adapted to abut against the ceiling surface;
   - a guide configured to retain the pair of wall extensions and carrying a bolt; and
   - a spacer coupled to the bolt and adapted to retain the wall panel against the wall extensions, wherein a height of the wall panel relative to the guide is defined by a position of the spacer relative to the bolt and wherein the spacer has a first plate and a second plate spaced from the first plate such that the first and second plates are connected the wall panel therefrom.

2. The apparatus of claim 1 wherein the guide is adapted to retain the wall extensions against the wall panel.

3. The apparatus of claim 1 wherein the bolt has a bolt body and a plurality of threads defined along the bolt body and the spacer includes a grommet having a threaded chamber adapted to threadingly receive the bolt body, and wherein the plurality of threads define a range of available heights for the wall panel relative to the wall extensions.

4. The apparatus of claim 1 wherein the pair of wall extensions and the spacer define a cavity for retaining insulation material.

5. The apparatus of claim 4 wherein the insulation material is configured to provide noise abatement.

6. The apparatus of claim 4 wherein the insulation material is configured to provide light abatement.

7. The apparatus of claim 1 wherein the spacer further includes a grommet having an elongated barrel extending through the first plate and the second plate, wherein the spacer is positionable at a first position wherein the elongated barrel is separated from the guide by the first and second plates or positionable at a second position wherein the first and second plates are separated from the guide by the elongated barrel.

8. The apparatus of claim 7 wherein the first plate and second plate are spaced from one another to form a gap adapted to retain flanges of the wall panel.

9. A wall system adapted for use in regions with seismic design criteria, the wall system comprising:
   - a wall panel;
   - a spacer connected to the wall panel; and a wall extension arrangement adapted to abut a ceiling and be engaged by the spacer at one of a plurality of heights, wherein the spacer has a first spacer element and a second spacer element separated from the first spacer element such that the first and second spacer elements are connected to the wall panel.

10. The wall system of claim 9 wherein the wall extension arrangement further includes a pair of plates, each abutting a respective outer surface of the wall panel.

11. The wall system of claim 10 wherein the wall extension arrangement further includes a guide connected to the plates.

12. The wall system of claim 11 further comprising a bolt included in the wall extension arrangement, the bolt having a body and a plurality of height-defining threads along the body.

13. The wall system of claim 12 wherein the spacer further includes a grommet having an elongated barrel extending through the first spacer element and the second spacer element, wherein the spacer is positionable at a first position wherein the elongated barrel is separated from the guide by the first and second spacer elements or positionable at a second position wherein the first and second spacer elements are separated from the guide by the elongated barrel.

14. The wall system of claim 10 wherein the plates and the spacer define a volume between the ceiling and the wall panel and further comprising noise and light abatement material in the volume.

15. An apparatus for extending the height of a wall panel to traverse a distance between a floor surface supporting the wall panel and a ceiling surface, comprising:

a pair of wall extensions adapted to snuggly fit against respective exterior walls of the wall panel;

a guide removably retaining the pair of wall extensions and carrying a threaded spacer; and a bolt threadably connected to the threaded spacer and adapted to carry the wall panel, wherein a height of the wall extensions relative to the wall panel is set by a position of the bolt on the threaded spacer, wherein the threaded spacer includes a first spacer element and a second spacer element separated from the first spacer element and a grommet having an elongated barrel extending through the first spacer element and the second spacer element, wherein the threaded spacer is positionable at a first position in which the elongated barrel is separated from the guide by the first and second spacer elements or positionable at a second position wherein the first and second spacer elements are separated from the guide by the elongated barrel.

16. The apparatus of claim 15 wherein the pair of wall extensions and the guide define a cavity, and further comprising insulating material disposed within the cavity.

17. The apparatus of claim 15 wherein the bolt is constructed such that clockwise rotation of the bolt increases the height of the wall extensions relative to the wall panel and counter-clockwise rotation of the bolt decreases the height of the wall extensions relative to the wall panel.

18. The apparatus of claim 15 wherein the guide is retained at a fixed position relative to the wall extension.

19. The apparatus of claim 15 wherein each wall extension includes a lip adapted to fit against the ceiling in a slip joint.

* * * * *

UNITED STATES PATENT AND TRADEMARK OFFICE

CERTIFICATE OF CORRECTION

PATENT NO. : 7,624,549 B2
APPLICATION NO. : 11/844856
DATED : December 1, 2009
INVENTOR(S) : Andrew J. Kopish It is certified that error appears in the above-identified patent and that said Letters Patent is hereby corrected as shown below:

In column 6, claim 1, line 25, after "connected" insert --to--.

In column 6, line 56, after "panel; and", insert a paragraph break, the new paragraph beginning with "a wall extension arrangement..."

Signed and Sealed this

Nineteenth Day of January, 2010

David J. Kappos

David J. Kappos
*Director of the United States Patent and Trademark Office*